US005505065A

United States Patent [19]

Hesse

[11] Patent Number: 5,505,065

[45] Date of Patent: Apr. 9, 1996

[54] LATCH FOR LUGGAGE, CONTAINERS OR THE LIKE

[75] Inventor: Klaus-Dieter Hesse, Sundern, Germany

[73] Assignee: Sudhaus Schloss- Und Beschlagtechnik GmbH & Co., Iserlohn, Germany

[21] Appl. No.: 178,061

[22] Filed: Jan. 6, 1994

[30] Foreign Application Priority Data

Jan. 28, 1993 [DE] Germany ..... 93 01 173 U

[51] Int. Cl.[6] ..... E05B 65/48

[52] U.S. Cl. ..... 70/73; 70/451; 70/367; 292/DIG. 29

[58] Field of Search ..... 292/247, DIG. 42, 292/DIG. 49, DIG. 38; 70/73–76, 451, 367, 422

[56] References Cited

U.S. PATENT DOCUMENTS

| | | | |
|---|---|---|---|
| 3,008,320 | 11/1961 | Cheney | 70/74 |
| 3,030,137 | 4/1962 | Cheney | 292/247 |
| 3,584,906 | 8/1969 | Budzyn | 70/73 |
| 3,593,550 | 7/1971 | Berkowitz | 70/490 |
| 3,698,753 | 10/1972 | Atkinson | 70/73 |
| 4,074,549 | 2/1978 | Yee | 292/247 |
| 4,186,952 | 2/1980 | Glass | 292/DIG. 38 |
| 4,195,867 | 4/1980 | Baillie | 292/174 |
| 4,224,975 | 9/1980 | Uehara | 160/206 |
| 4,226,454 | 10/1980 | Tranberg et al. | 70/380 |
| 4,270,780 | 6/1981 | Benard | 292/DIG. 64 |
| 4,550,580 | 11/1985 | Neyret | 70/451 |
| 4,910,982 | 3/1990 | Dana | 70/451 |
| 5,257,839 | 11/1993 | Nielsen et al. | 292/247 |

*Primary Examiner*—Barnell M. Boucher
*Attorney, Agent, or Firm*—Herbert Dubno

[57] ABSTRACT

A simplified latch for luggage, cases and the like has a tubular bolt with an eccentric cam engaging beneath an over-hanging tab of a base to which the lever plate is connected by a linkage when that tubular cam is rotated by insertion of a key in a key shaft within the tubular bolt and fixed axially with respect to the lever plate.

10 Claims, 5 Drawing Sheets

LATCH FOR LUGGAGE, CONTAINERS OR THE LIKE

FIELD OF THE INVENTION

The present invention relates to a latch for an attache case, suitcase, trunk or, more generally, a container, receptacle or case and which has a pair of latch members, one of which is provided with a key-operated bolt for locking the latch members together or enabling them to move relatively in locking and open positions thereof. More particularly the invention relates to a latch of the type described in which one latch member, which can be referred to as a lever member, is swingably mounted on the other latch member or base, into engagement with a part of the article, provided with the latch which is to be locked to the part on which the base member is mounted.

BACKGROUND OF THE INVENTION

Latches which are formed with locks of the afore-described type are, of course, commonly available in numerous applications and constructions for all kinds of luggage articles, cases and, more generally, containers of all types. These devices or units generally have two parts which can be latched together to hold the parts closed. One part can be a cover part while the other part can form the balance of the container.

One of the problems with conventional latches for the purposes described is that the latch and lock assemblies have large numbers of parts which frequently must be mounted in a complex manner and often require the use of mounting plates within the receptacle or article of luggage to hold the parts in place.

It has long been desired to simplify the lock and latch assemblies for containers and especially articles of luggage.

OBJECTS OF THE INVENTION

It is, therefore, the principal object of the present invention to provide a latch for an article of luggage which has a minimum number of parts and which can include a simplified lock for operation by a key and which can retain the article in its locked position if desired.

Another object of my invention is to provide a latch construction which can eliminate the need to provide retaining plates on the interior of the article to hold the portions forming the engaging parts on the exterior thereof.

Still another object of the invention is to provide a low-cost latch assembly which can be operated and assembled in a simple manner and which nevertheless can provide effective locking of the article in its closed position.

It is still another object of this invention to provide an improved latch, especially for articles of luggage like carrying cases of all types, which can overcome problems of prior art latches for luggage and the like.

SUMMARY OF THE INVENTION

These objects and others which will become apparent hereinafter are attained, in accordance with the present invention, by providing the lock of the latch assembly with a substantially hollow cylindrical bolt which is rotatable on one member of the latch and in one angular position can engage another member of the latch to prevent opening of the latch while, in another angular position, the opening is permitted. According to the invention in the interior of this hollow cylindrical bolt, a key shaft is provided which is axially fixed in the first latch member but is rotatable independently of the surrounding tubular bolt. The key which can be inserted into a slit or slot of this key shaft can have a bit, preferably two bits, which can engage the surrounding tubular bolt when the key is fitted into the shaft to allow both the shaft and the tubular bolt to be rotated and hence entrainment of the tubular bolt with the key and the shaft between the angular positions described.

More particularly, a latch for an article of luggage or other container having two parts to be latched together can comprise:

- a first latch member on one of the parts;
- a second latch member at least engageable with the other of the parts and movable relative to the first latch member; and
- a lock on one of the latch members engageable with the other of the latch members to prevent movement of the latch members from a closed position into an open position, the lock comprising:
  - a tubular bolt rotatable on the one of the latch members and provided with a formation locking with the other of the members in one angular position of the bolt and releasing the other of the members in another angular position of the tubular bolt, and
  - a shaft extending through the bolt, axially fixed in the one of the members and angularly displaceable in the bolt, the shaft being formed with a key-receiving slit enabling insertion of a key having at least one bit engaging the tubular bolt to rotate both the tubular bolt and the shaft between the angular positions of the bolt.

The concentric and axially-fixed arrangement of the locking bolt and the key shaft or axle on which the bolt is rotatable in the latch member ensures reliable locking with a significantly reduced number of parts both for the lock and for the latch generally. Indeed, backing plates or the like are not required with the device of the present invention. The physical separation of the key shaft on the one hand and the tubular bolt on the other, enables the key shaft to be used to secure the tubular bolt on the latch member provided with the lock and ensures that the rotation of the shaft alone, e.g. by a tool other than the intended key, will not effect entrainment of the tubular bolt and thus will not allow opening of the lock when such opening is not desired.

It will be understood that the entrainment of the tubular bolt by the bits of the key with the key shaft can only occur when a proper key is inserted into the key slit and the bits are such that entrainment of the tubular bolt is possible.

It has been found to be advantageous to provide the locking formation of the tubular bolt as an outwardly projecting eccentric cam on the tubular bolt, like the cam of a so-called cam lock, which can engage beneath an inwardly bent lip or tab on a shank of a base forming one of the latch members so that the shank is perpendicular to the base plate and the tab is parallel to and overhangs the latter. Upon rotation of the tubular bolt, further, the eccentric cam can be swung into a position underlying this tab which is parallel to the base plate.

Axial securing of the tubular bolt in place can be effected by providing at the end of the key shaft opposite the key slit, at least one clip protuberance which can be cammed inwardly when the shaft is inserted into the tubular bolt but which can jump outwardly to engage beneath a shoulder forming a bottom of a recess provided in the tubular bolt at its end opposite the key insertion end and accommodating the protuberances. The protuberances project radially outwardly and the shaft may have above the tubular bolt, an annular flange overhanging the latch member provided with the lock. To prevent the tubular bolt from being pulled out of the lever member of the latch with the shaft, a similar shoulder can be provided in an inner wall of a tubular base of this lever.

A secure axial seat of the key shaft in the tubular bolt can be ensured by providing the inner periphery of the tubular bolt and the outer periphery of the key shaft so that they both taper continuously from the key-insertion end to the end provided with the cam.

Advantageously, at the key-insertion end, the tubular bolt is provided with a pair of slits or recesses or cutouts into which the bits of the key can engage when these cutouts are radially aligned with the key slit in the key shaft. The cutouts are open axially to allow insertion of the key bits into them.

Effective mounting of the tubular bolt in the tubular boss of the latch and indexing in the locking and opening position can be obtained by providing on the outer surface of the tubular bolt, a radially-outwardly projecting indexing stop which can engage counter-stops on the tubular boss in the aforementioned angular positions.

It has been found to be highly economical and kinematically advantageous to provide the mechanical connection between the base member and the lever member of the latch in terms of a linkage or pivot lever arrangement. The linkage can provide a first pivot on the lever member and a second pivot on the base member connected by links.

To enable a compact configuration of the lock, the base plate may be provided with a partial circular recess whose diameter is such that it will allow the sweep of the eccentric cam when the latch is in its closed position as that cam is swung between its opening and locking positions.

The lever plate can be formed with a nose engageable with the other parts of the article, the base of the latch being mounted on a first part thereof. The linkage permits the lever member to separate from the base member and to swing over the portion of the other part provided with the recess and to draw the two parts of the article together. A prestressing of the lock can be obtained by forming the linkage as part of a toggle arrangement. In this case, the second pivot, upon swinging of the lever into the closed position, is so located that the line connecting the contact point of the locking nose and the first pivot swings past the second pivot. This toggle arrangement is enhanced by an arrangement wherein in swinging the lever plate into a position in which the nose engages in the recess, a line connecting the nose to the second pivot swings past a line connecting the pivots and a straight-line distance between the nose and the second pivot is less than the sum of a straight-line spacing of the pivots and a straight-line spacing of the nose from the one pivot.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
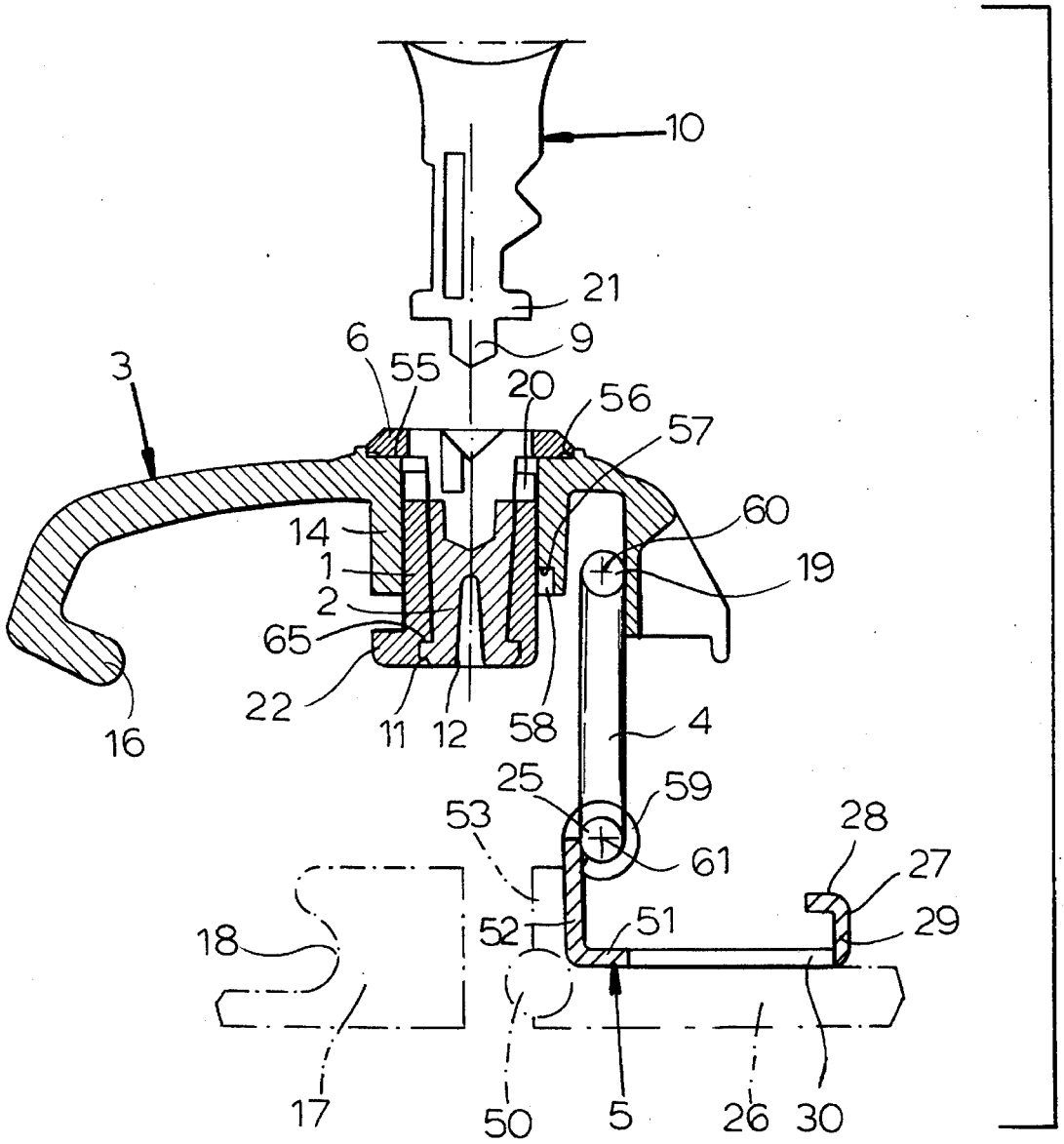
FIG. 1 is a cross sectional view, somewhat in exploded form, illustrating a latch according to the invention in the open position.
Figure 2:
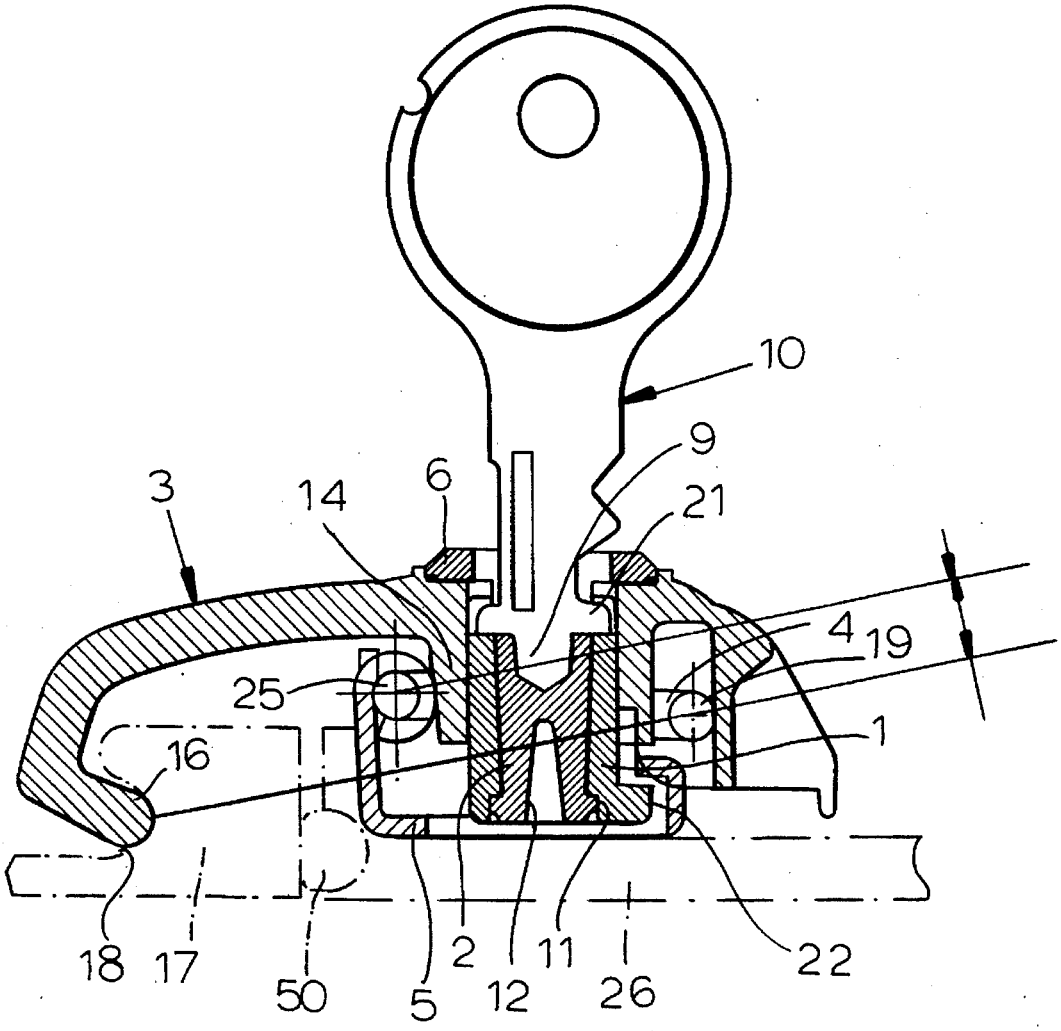
FIG. 2 is a cross sectional view of the latch in its closed position showing the key having turned the tubular bolt into its locking position.

The latch shown in FIGS. 1 and 2 is illustrated in its opening position (FIG. 1) in its closed position (FIG. 2) and is intended for a case to latch two parts 17 and 26 together. One of these parts may be the cover of the case while the other is the base. One part may have a compressible sealing bead 50 shown in its fully-expanded condition in FIG. 1 and partly compressed in FIG. 2.

The significant elements of the latch seen in FIGS. 1 and 2 are the tubular locking bolt 1, a key shaft 2, a lever plate 3, a linkage formed by a pair of links or link levers 4 and a base part 5.

Figure 15:
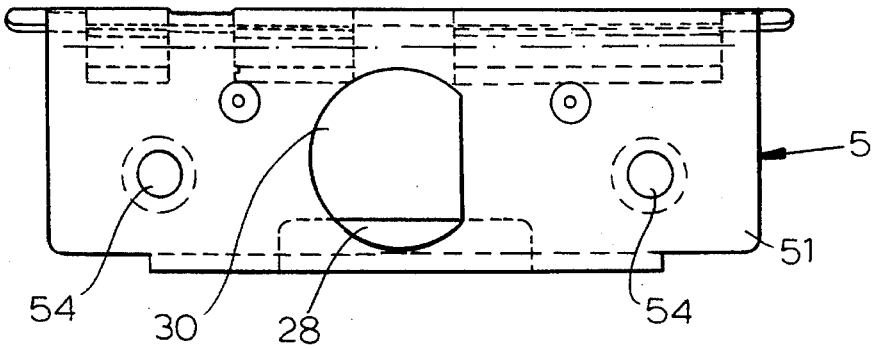
FIG. 15 is a bottom view of the base.

The base part 5 may be formed with a base plate 51 having an opening 30 to be described in greater detail hereinafter, an upright flange 52 which can lie against the ridge 53 of the part 26 of the article of luggage to which the base plate 51 may be secured by screws through the holes 54 (FIG. 15). On the flange 52 are a pair of eyes 59 forming a second pivot as will be described.

Opposite the flange 52 is a flange 29 also perpendicular to the plane of the base plate 51 and having an inwardly turned tab 28 which overhangs the opening 50 (FIG. 1).

The head 6 of the key shaft 2 is in the form of a flange which fits in a recess 55 in the lever plate 3 within a ridge 56 so that the key shaft can rotate. The tubular bolt 1 has a lateral projection 24 which will be discussed in greater detail below and rests against a shoulder 57 at the base of a recess 58 preventing the tubular bolt 1 from being pulled upwardly out of the lever plate 3.

Figure 14:
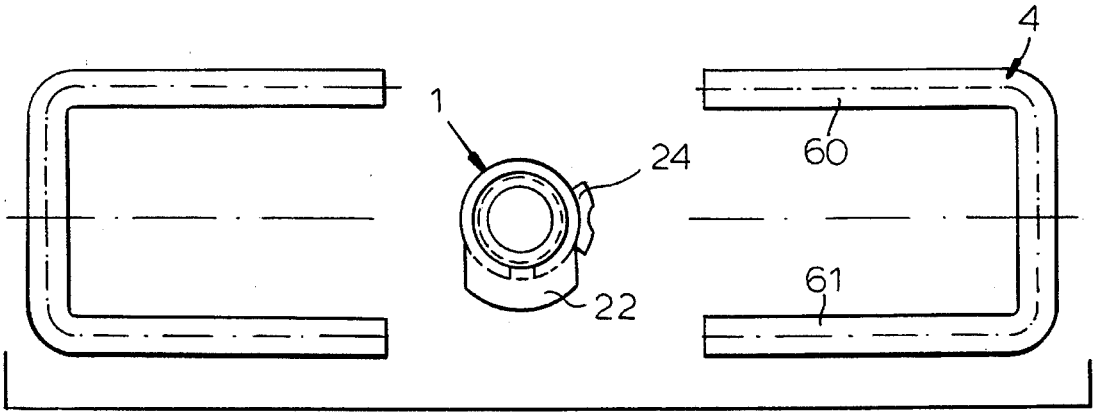
FIG. 14 is a bottom view of the tubular bolt and the links forming the linkage.

The links 4 (FIG. 14) each have a pair of arms 60, 61 receivable in the eyes 59 of the base and in bores 62 of the lever plate 3 to form the first pivots 19 in the latter case.

Figure 3:
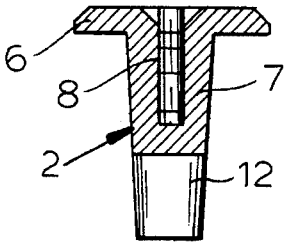
FIG. 3 is an axial section through the key shaft of the lock of the invention.
Figure 4:
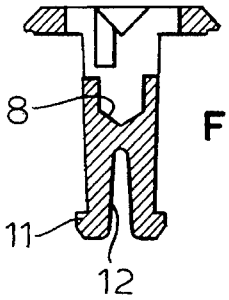
FIG. 4 is a cross sectional view through the key shaft rotated through 90° of the view of FIG. 3.
Figure 5:
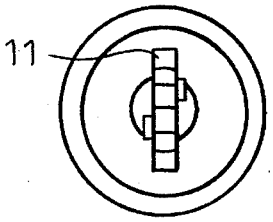
FIG. 5 is a plan view of the key shaft.
Figure 6:
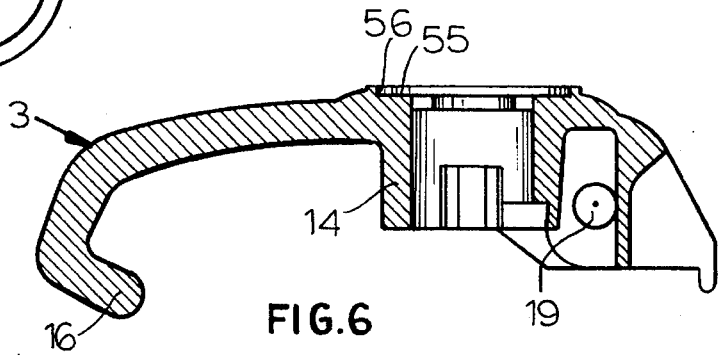
FIG. 6 is a cross sectional view of the lever plate of the lock of the invention.

Referring to FIGS. 3–5 in which the key shaft 2 is shown in greater detail, it will be apparent that in addition to the head 6, the key shaft 2 has a shank 7 formed with a key slit 8 into which the bits 9 and the corresponding end of a key 10 can be inserted as long as that key fits the slit.

At the end of the key shaft 2 remote from the key slit, the shank 7 is formed with clip protuberances 11 which project radially outwardly.

The shank 7 tapers continuously toward the end provided with the clips 11, i.e. is of continuously diminished diameter in this direction.

To allow the shank to compress in the region of the clip protuberances 11, the shank 7 is formed with a recess 12 opening at the split free end of the key shaft. As a consequence, the key shaft 2 can be simply inserted into the tubular bolt 1 to cam the end provided with the protuberances 12 inwardly and permit those protuberances 11 to engage behind shoulders 65 formed at the base of a recess 23 (FIG. 8) at the corresponding end of the tubular bolt, the protuberances 11 springing outwardly because of the elasticity of the shank 7 to simplify the mounting of the key shaft in the tubular bolt. The shoulder 13 aligned with the recess 55 and the ridge 56 of the lever plate 3 is a cylindrical boss 14 in which the assembly of the shank 7 and the tubular bolt 1 can be received.

On the inner surface of the cylindrical boss 14 of lever plate 3 there are provided two counter-stops 15 which can be engaged by the radial projection or indexing stop 24 of the tubular bolt when the latter is rotated between its open and closed positions.

One end of the lever plate 3 has a nose 16 which is engageable in a recess 18 of a wall 17 of the article of luggage or container.

At its end opposite the nose 16, the lever plate 3 is formed with the first pivot 19 in the manner described, via one side of the two-link linkage 4.

Figure 7:
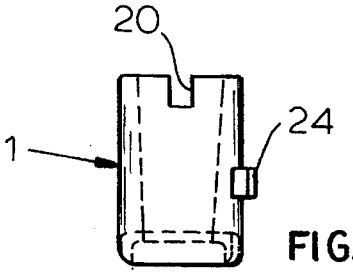
FIG. 7 is a side elevational view of the tubular bolt of this lock.
Figure 8:
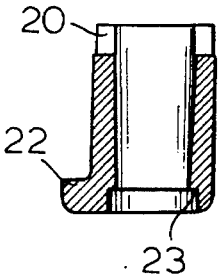
FIG. 8 is an axial section through the tubular bolt.
Figure 9:
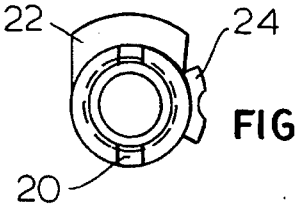
FIG. 9 is a plan view of the tubular bolt.
Figure 10:
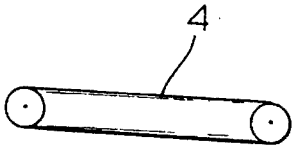
FIG. 10 is a side view of one of the links of the linkage.
Figure 11:
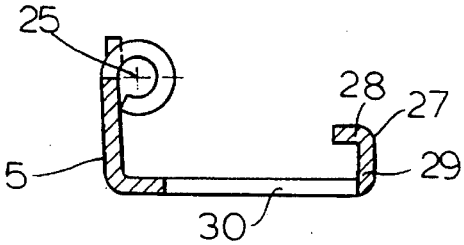
FIG. 11 is a cross sectional view of the base member of the latch.
Figure 12:
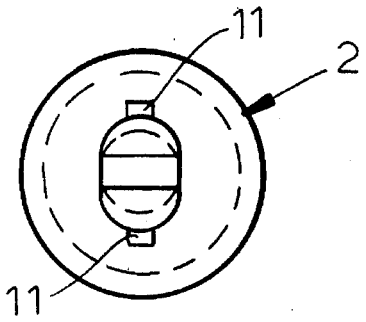
FIG. 12 is a bottom view of the key shaft.
Figure 13:
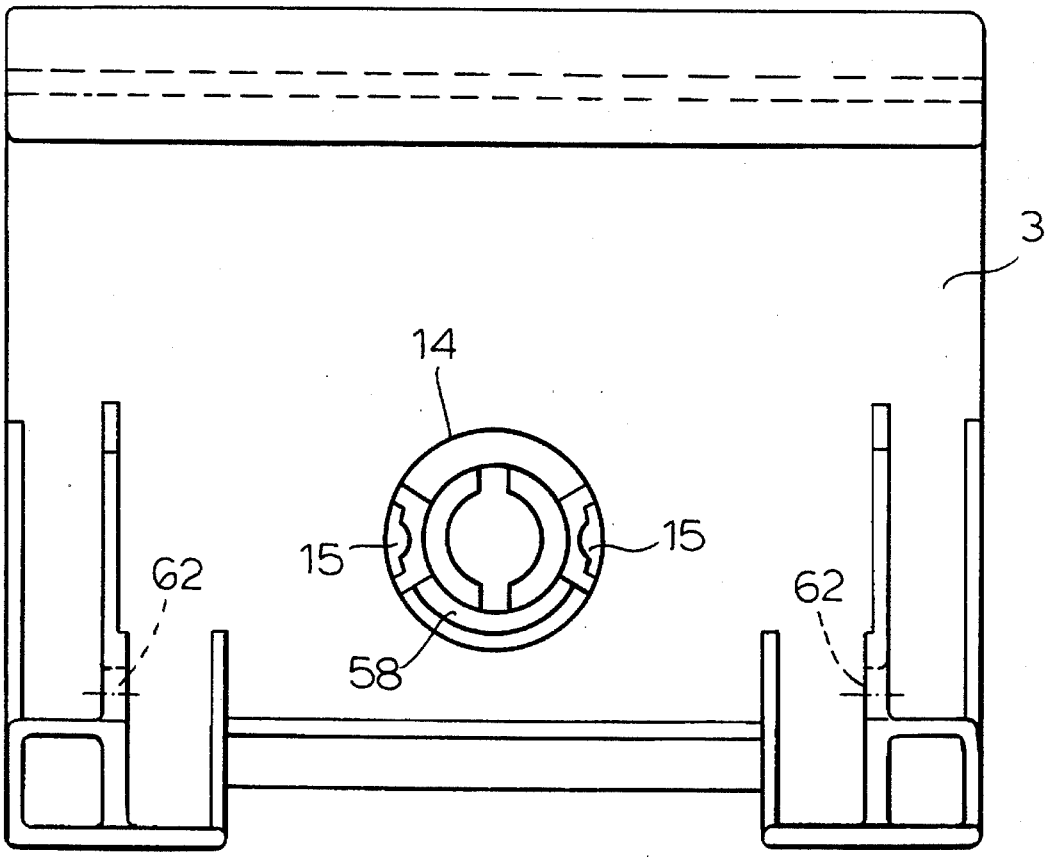
FIG. 13 is a bottom view of the lever plate.

FIGS. 7–9 show the tubular bolt 1 in greater detail and from these Figures it can be seen that the tubular bolt is substantially hollow cylindrical and is formed at its upper end with two cutouts 20 extending to the end face of the bolt and radially alignable with the key slit 8 in the key shaft 2 to receive respective bits 9 of the key 10 when the latter is inserted into the lock downwardly in FIG. 1.

The inner diameter of the hollow cylindrical bolt 2 reduces progressively downwardly away from the cutouts 20 complementarily to the taper of the shank 7 of the key shaft 2.

At the end opposite the cutouts 20, the tubular bolt 1 is provided with an eccentric cam 22 which projects radially from the outer periphery of the hollow cylindrical tubular bolt 1. This cam is engageable beneath the tab 28 to lock the latch or can be swung to clear this tab for opening of the latch.

The recess 23 in which the clip protuberances 11 of the locking shaft engage has already been described and forms the annular shoulder 65 beneath which the protuberances can grip. The key shaft can thus rotate within tubular bolt 1 and the tubular bolt can rotate within the locking plate 3. A vertical movement of the tubular bolt 1 and the key shaft 2 is prevented by the engagement of the flange 6 against the bottom of recess 55 and the engagement of the lateral projection 24 against the shoulder 57.

The rotation of the tubular bolt is limited by the engagement of the counterstops 15 with the indexing stop 24 in the open and locked positions respectively.

Each linkage lever 4 is provided with a U configuration in which the shanks define the first pivot 19 and the second pivot 25 on the lever plate 3 and the base 5, respectively.

Upon folding of the linkage 4 downwardly and in a clockwise sense about its second pivot 25, the nose 16 is engageable in a recess 18 and the bolt 1 and shaft 2 can be rotated so that the cam 22 engages beneath the tab 28 to lock the latch.

In the open position, the lever plate 3 can be spring-loaded into the position shown in FIG. 1. For that purpose, each of the pivots 25 and 19 can be provided with torsion springs which retain the lock in the position shown in FIG. 1.

Upon the insertion of the key 10 into the key slit 8 of the shaft 2, the bits 9 which project diametrically on the key can engage in the cutouts 20 so that the tubular bolt 1 is rotatably entrained with the key shaft for rotation into the locking position.

The cutout 30 allows the cam 22 to approach the part 26 of the article upon which the latch is mounted, thereby affording a flatter appearance to the latch. The cam 22 can engage beneath the tab 28 with some play to minimize the force required to rotate the key. The stops readily signal the attainment of the opening of the closing position in the rotation of the key of the user.

As can be seen from FIG. 2, the second pivot 25 is so located when the lever plate 3 is brought into its closing position that it lies above the connection line between the nose 16 and the first pivot 19. This provides a prestress to the latch which is reinforced by the compression of the bead 50 to retain the latch in its locking position. A toggle action is achieved in that the straight-line distance between the nose 16 and the pivot 19 is less than the sum of the straight-line distances between the nose 16 and the pivot 25 and between the pivots 25 and 19.

I claim:

1. A latch for an article of luggage or container having two parts to be latched together, said latch comprising:

a first latch member on one of said parts;

a second latch member at least engageable with the other of said parts and movable relative to said first latch member; and a lock on one of said latch members engageable with the other of said latch members to prevent movement of said latch members from a closed position into an open position, said lock comprising:

a hollow cylindrical tubular bolt rotatable on said one of said latch members and provided with a formation locking with said other of said members in one angular position of said bolt and releasing said other of said members in another angular position of said tubular bolt, and a shaft extending through said bolt, axially fixed in said one of said members and angularly displaceable in said bolt, said shaft being formed with a key-receiving slit enabling insertion of a key having at least one bit engaging said tubular bolt to rotate both said tubular bolt and said shaft between said angular positions of said bolt, said shaft having a head at an end provided with said key-receiving slit and braced against said one of said members and said shaft being formed at an opposite end thereof with outwardly projecting clip protuberances engaging directly beneath a shoulder formed in said tubular bolt at a base of an axially open recess accommodating said protuberances at said opposite end.

2. The latch defined in claim 1 wherein said formation is an outwardly projecting eccentric cam formed on an outer periphery of said tubular bolt, said other latch member having an inwardly bent tab parallel to a base of said other latch member and beneath which said eccentric cam engages, said tab being formed on a shank of said other member perpendicular to said base.

3. The latch defined in claim 1 wherein said tubular bolt has an inner bore tapering toward said opposite end and said shaft has an outer periphery tapering toward said end complementarily to said bore.

4. The latch defined in claim 1 wherein said tubular bolt having at an end thereof opposite said formation a pair of cutouts alignable radially with said slit and receiving said bit for joint rotation of said bolt and said shaft by said key.

5. The latch defined in claim 1 wherein said tubular bolt is formed along an outer periphery thereof with a radially projecting indexing stop engageable with counterstops formed along an inner periphery of a tubular boss on said one of said members receiving said tubular bolt and said shaft, one of said counterstops being engaged by said indexing stop in one of said angular positions, the other of said counterstops being engaged by said indexing stop in the other of said angular positions.

6. The latch defined in claim 1, further comprising a linkage articulated at one pivot to said one of said latch members and at a second pivot to said other of said latch members.

7. The latch defined in claim 1 wherein said other of said members has a part circular recess receiving said formation and of a diameter sufficient to permit sweep of said cam between said angular positions within said recess.

8. The latch defined in claim 6 wherein said one of said latch members is a lever plate having an inwardly turned nose engaging a recess of said other part.

9. The latch defined in claim 8 wherein in swinging said lever plate into a position in which said nose engages in said recess, a line connecting said nose to said second pivot swings past a line connecting said pivots and a straight-line distance between said nose and said second pivot is less than the sum of a straight-line spacing of said pivots and a straight-line spacing of said nose from said one pivot.

10. The latch defined in claim 2 wherein:

said tubular bolt has an inner bore tapering toward said end and said shaft has an outer periphery tapering toward said end complementarily to said bore, said tubular bolt has at an end thereof opposite said formation a pair of cutouts alignable radially with said slit and receiving said bit for joint rotation of said bolt and said shaft by said key, said tubular bolt is formed along an outer periphery thereof with a radially projecting indexing stop engageable with counterstops formed along an inner periphery of a tubular boss on said one of said members receiving said tubular bolt and said shaft, one of said counterstops being engaged by said indexing stop in one of said angular positions, the other of said counterstops being engaged by said indexing stop in the other of said angular positions, a linkage is articulated at one pivot to said one of said latch members and at a second pivot to said other of said latch members, said other of said members has a part circular recess receiving said formation and of a diameter sufficient to permit sweep of said cam between said angular positions within said recess, and said one of said latch members is a lever plate having an inwardly turned nose engaging a recess of said other part, and wherein in swinging said lever plate into a position in which said nose engages in said recess, a line connecting said nose to said second pivot swings past a line connecting said pivots and a straight-line distance between said nose and said second pivot is less than the sum of a straight-line spacing of said pivots and a straight-line spacing of said nose from said one pivot.

* * * * *